US011565302B2

(12) United States Patent
Matsui et al.

(10) Patent No.: US 11,565,302 B2
(45) Date of Patent: Jan. 31, 2023

(54) PRESS WORKING APPARATUS, AND SETTING METHOD AND MAINTENANCE METHOD THEREOF

(71) Applicant: TOYOTA BOSHOKU KABUSHIKI KAISHA, Aichi (JP)

(72) Inventors: Takamasa Matsui, Aichi (JP); Masaki Takenaka, Aichi (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 353 days.

(21) Appl. No.: 16/375,491

(22) Filed: Apr. 4, 2019

(65) Prior Publication Data

US 2019/0314884 A1 Oct. 17, 2019

(30) Foreign Application Priority Data

Apr. 11, 2018 (JP) ..... JP2018-076146

(51) Int. Cl.
*B21D 43/28* (2006.01)
*B21D 22/02* (2006.01)
*B21D 37/12* (2006.01)

(52) U.S. Cl.
CPC ..... *B21D 43/287* (2013.01); *B21D 22/02* (2013.01); *B21D 37/12* (2013.01)

(58) Field of Classification Search
CPC .... B21D 43/287; B21D 43/003; B21D 28/04; B21D 37/12; B21D 22/02; B21D 37/10; B21D 37/14; B21D 43/00; B21D 37/04; B21C 51/00
USPC ..... 72/19.5
See application file for complete search history.

(56) References Cited

U.S. PATENT DOCUMENTS 4,342,214 A * 8/1982 Neuendorf ..... B21D 28/04 267/137
2002/0095969 A1* 7/2002 Matsunaga ..... B21D 37/12 72/350
2012/0011710 A1* 1/2012 Iwamoto ..... B21D 43/003 29/759
2012/0174384 A1* 7/2012 Leconte ..... B21D 11/14 29/558
2013/0247638 A1* 9/2013 Horii ..... B21B 45/0218 72/201

(Continued)

FOREIGN PATENT DOCUMENTS

CA 3007608 A1 * 8/2017 ..... B21D 39/035
FR 2983746 A1 * 6/2013 ..... B21D 37/12

(Continued)

OTHER PUBLICATIONS

Machine translation of JP 2003191029 (Year: 2003).*

(Continued)

*Primary Examiner* — Shelley M Self
*Assistant Examiner* — Teresa A Guthrie
(74) *Attorney, Agent, or Firm* — Greenblum & Bernstein, P.L.C.

(57) ABSTRACT

A press working apparatus includes: a first positioner that is provided to at least one press of a first press or a second press and that performs positioning of at least one die of the at least one press; and a second positioner that performs positioning of the at least one die and that positions the at least one die in a position deviated in a feeding direction with respect to the first positioner.

8 Claims, 6 Drawing Sheets

(56) References Cited

U.S. PATENT DOCUMENTS

| | | | | |
|---|---|---|---|---|
| 2013/0316132 | A1* | 11/2013 | Yuasa | B21D 22/022 428/132 |
| 2016/0059295 | A1* | 3/2016 | Frost | B21D 24/005 72/354.6 |
| 2016/0214160 | A1* | 7/2016 | Hidaka | B21D 37/12 |
| 2017/0252793 | A1* | 9/2017 | Carstens | B21D 43/12 |

FOREIGN PATENT DOCUMENTS

| | | | | |
|---|---|---|---|---|
| FR | 2984190 | A1 * | 6/2013 | B21D 37/12 |
| JP | H11169968 | A | 6/1999 | |
| JP | 2003191029 | A | 7/2003 | |
| JP | 2014-172079 | | 9/2014 | |

OTHER PUBLICATIONS

Notice of Reasons for Refusal dated Sep. 7, 2021 in Japanese patent application No. 2018-076146 and corresponding machine-generated English translation.

* cited by examiner

PRESS WORKING APPARATUS, AND SETTING METHOD AND MAINTENANCE METHOD THEREOF

CROSS-REFERENCE TO RELATED APPLICATIONS

This application claims the benefit of Japanese Patent Application No. 2018-076146 filed on Apr. 11, 2018 with the Japan Patent Office, the entire disclosure of which is incorporated herein by reference.

BACKGROUND

The present disclosure relates to a press working apparatus of a progressive type, and so on.

The press working apparatus of a progressive type is a processing apparatus that plastically deforms a metal material having a strip-plate shape to form the metal material into a specified shape while feeding the metal material in one direction, as disclosed in, for example, Japanese Unexamined Patent Application Publication No. 2014-172079.

SUMMARY

In press working, it is generally difficult to obtain dimensional accuracy equivalent to that obtained in cutting work. Thus, in manufacture of machine parts required to have high dimensional accuracy, cutting work is generally performed after the press working.

The present disclosure discloses examples of a press working apparatus of a progressive type enabling obtainment of dimensional accuracy equivalent to that obtained in cutting work, examples of a setting method of the press working apparatus, and examples of a maintenance method of the press working apparatus.

In one aspect of the present disclosure, it is desirable that a press working apparatus of a progressive type that plastically deforms a metal material having a strip-plate shape to form the metal material into a specified shape while feeding the metal material in one direction comprises: a first press comprising at least one die that press-forms a first shape in the metal material; a second press comprising at least one die that press-forms a second shape in the metal material in which the first shape is formed; a first positioner provided to at least one press of the first press or the second press, the first positioner performing positioning of the at least one die of the at least one press; and a second positioner that performs positioning of the at least one die of the at least one press, the second positioner positioning the at least one die of the at least one press in a position deviated in a feeding direction with respect to the first positioner.

The metal material is generally elongated by being subjected to press working. Thus, in relation to required dimensional accuracy, it is feared that, if an elongation quantity of the metal material is large, a phenomenon may occur in which a position of the metal material with respect to the at least one die is displaced from a proper position (hereinafter referred to as a "displacement phenomenon").

In the present disclosure, the at least one die of the at least one press can be positioned with consideration of the elongation quantity of the metal material caused in a working process prior to that performed by the at least one press. Thus, a position of the at least one die of the at least one press can be a proper position with consideration of the elongation quantity of the metal material, resulting in obtainment of dimensional accuracy equivalent to that obtained in cutting work.

If the displacement phenomenon occurs, it is difficult to perform press-forming that achieves the required dimensional accuracy because of the displacement phenomenon. Such cause is included in the findings of the inventors of the present disclosure.

The press working apparatus may be configured as below. Specifically, in general press working apparatuses, press working required to achieve high dimensional accuracy is performed in the last step of each press working apparatus in most cases. Thus, it is desirable that the first positioner and the second positioner be provided to a press that performs the last press-forming. This enables obtainment of the dimensional accuracy equivalent to that obtained in cutting work.

It is desirable that a distance in the feeding direction between the at least one die of the first press and the at least one die of the second press (hereinafter referred to as a "process interval") be set by the following method.

Specifically, the first press is operated and the elongation quantity of the metal material is measured, a target value of the distance in the feeding direction between the at least one die of the first press and the at least one die of the second press is determined based on the measured elongation quantity, and an actual distance in the feeding direction is adjusted to the determined target value of the distance.

BRIEF DESCRIPTION OF THE DRAWINGS

Example embodiments of the present disclosure will be described below with reference to the accompanying drawings, in which.

DETAILED DESCRIPTION OF THE PREFERRED EMBODIMENTS

Figure 1:
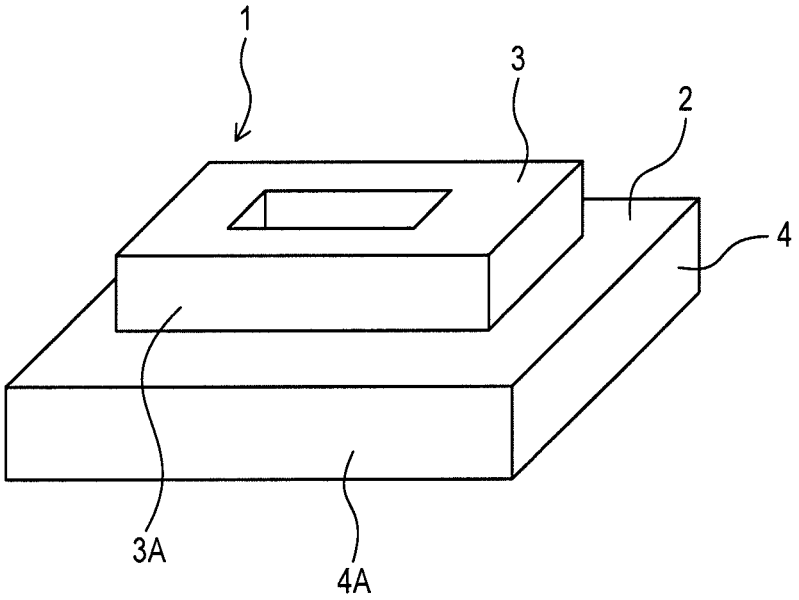
FIG. 1 is a diagram showing a product according to a first embodiment.

Embodiments described below are example embodiments falling within the technical scope of the present disclosure. In other words, invention-specifying matters and so on recited in the appended claims are not limited by specific configurations, structures, and so on, shown in the below-described embodiments.

At least a member or portion described with a reference numeral assigned thereto is at least one in number unless accompanied by a specifying term, such as "only one". In other words, the member or portion may be two or more in number if not accompanied by a specifying term, such as "only one".

First Embodiment

1. Overview of Press Working Apparatus

The present embodiment relates to a press working method for forming a press-formed product (hereinafter referred to as a "product") 1 shown in FIG. 1, and to a press working apparatus using the press working method. As shown in FIG. 2, the product 1 comprises a stepped portion 2. The geometrical tolerance (coaxiality in the present embodiment) between an outer peripheral surface 3A of an upper step part 3 and an outer peripheral surface 4A of a lower step part 4 in the product 1 is required to have dimensional accuracy equivalent to Class f (fine) of machining.

Figure 3:
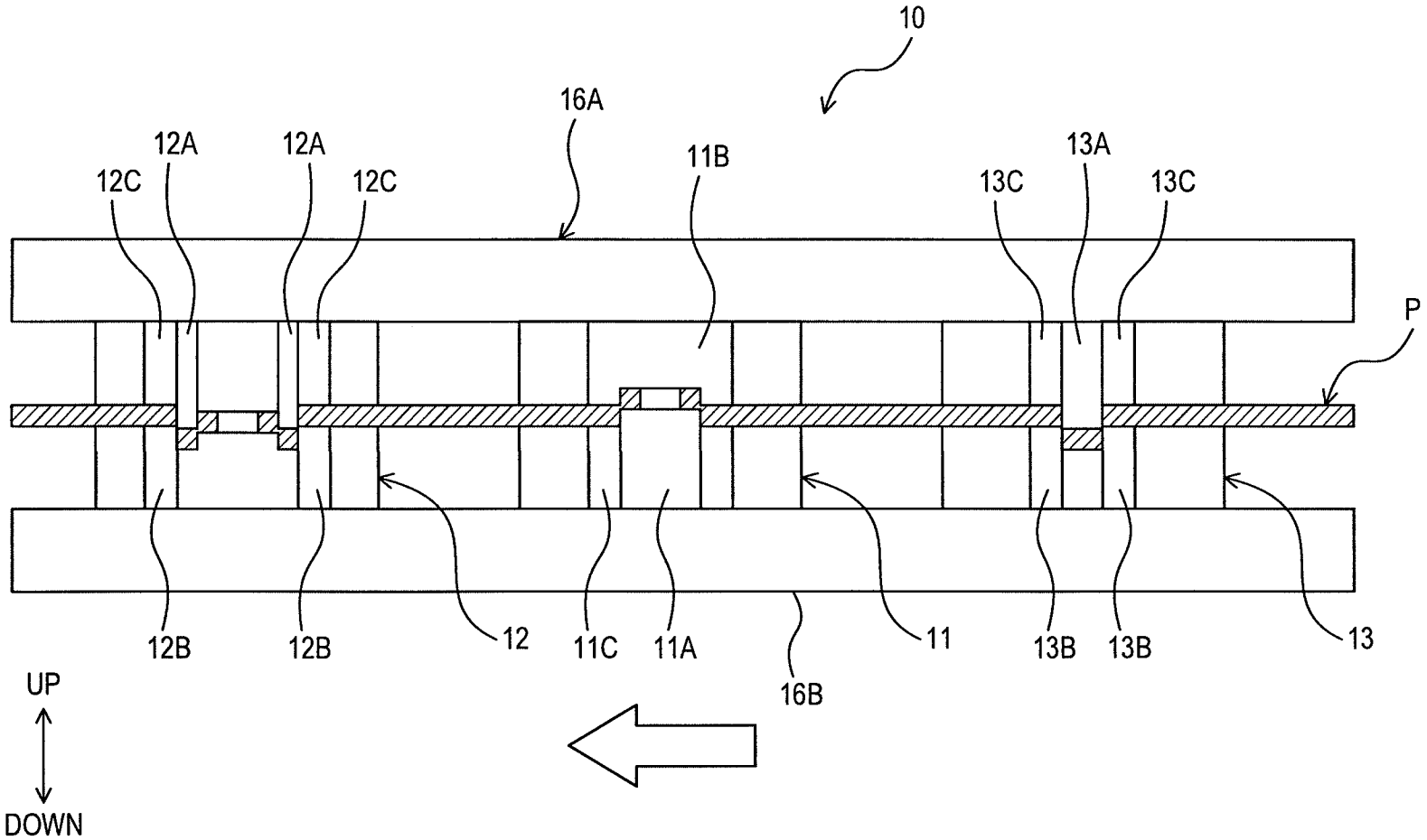
FIG. 3 is a diagram showing a press working apparatus according to the first embodiment.
Figure 4:
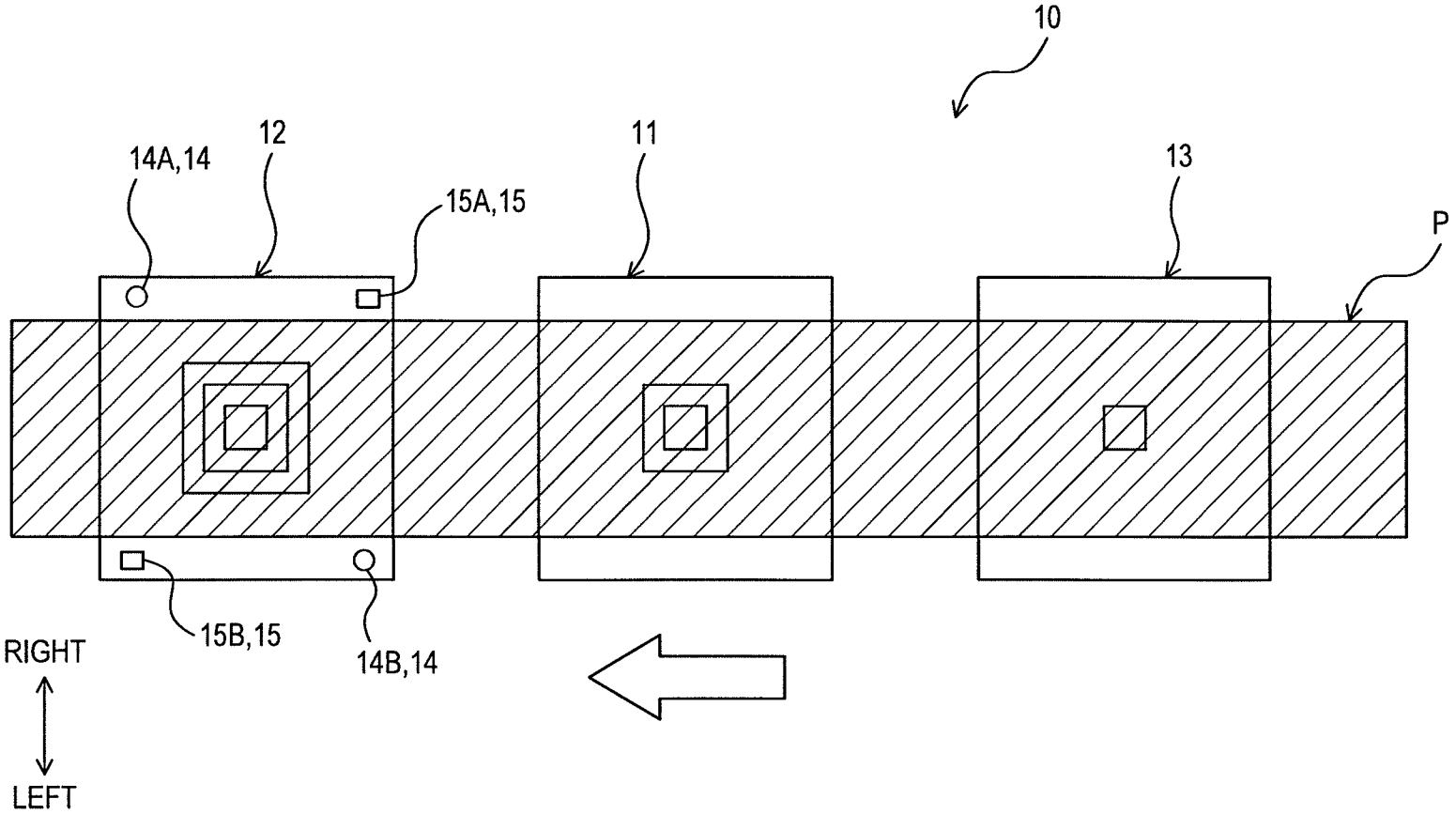
FIG. 4 is a diagram showing the press working apparatus according to the first embodiment.

A press working apparatus 10 shown in FIGS. 3 and 4 is a press working apparatus of a progressive type that plastically deforms a metal material P having a strip-plate shape to form the metal material P into a specified shape while feeding the metal material P in one direction (in a direction indicated by the bold arrow in FIG. 3).

In other words, the press working apparatus 10 enables practice of the press working method in which a sheet of the metal material P is subjected to plastic working sequentially to thereby integrally form the outer peripheral surface 3A of the upper step part 3 and the outer peripheral surface 4A of the lower step part 4.

Arrows and so on indicating directions shown in the drawings are provided to facilitate understanding of mutual relationships between the drawings. Thus, the present disclosure is not limited by the directions shown in the drawings.

2. Details of Press Working Apparatus

<Overview of Configuration>

As shown in FIG. 3, the press working apparatus 10 comprises at least a first press 11 and a second press 12. The press working apparatus 10 of the present embodiment comprises a punch press 13 in addition to the first press 11 and the second press 12. The metal material P is subjected to plastic working sequentially while being fed to the punch press 13, the first press 11, and the second press 12, in this order.

The first press 11, the second press 12, and the punch press 13 of the present embodiment are presses utilizing the principle of fine blanking processing. The fine blanking processing is a press working performed while applying a pressure equivalent to a hydrostatic pressure to the metal material P as a material, in addition to a shear pressure by the press working.

<Punch Press>

The punch press 13 forms a punched hole 5 (see FIG. 2) of the product 1 by punching. The punch press 13 comprises at least a punch 13A and a die 13B as dies for forming by punching.

The punch 13A is a male die. The die 13B is a female die. The punch 13A shaped like a rectangular column is movable relative to the die 13B so as to fit into the die 13B shaped like a rectangular cylinder.

In this way, the punched hole 5 is formed in the metal material P by punching. A stripper 13C spaces away the metal material P closely adhered around the punch 13A during punching of the metal material P by the punch 13A.

<First Press>

The first press 11 forms the upper step part 3 and the outer peripheral surface 3A (hereinafter also referred to as a first shape) of the product 1. The first press 11 comprises at least a punch 11A and a die 11B as dies for press-forming the first shape.

The punch 11A is a male die. The die 11B is a female die. The punch 11A shaped like a rectangular column is movable relative to the die 11B so as to press the metal material P into a rectangular concave portion provided in the die 11B. In this way, the first shape of the product 1 is press-formed in the metal material P.

A portion of the metal material P restrained by an inner peripheral surface of the concave portion is formed as the outer peripheral surface 3A. A stripper 11C spaces away the metal material P closely adhered around the punch 11A during relative movement of the punch 11A relative to the die 11B.

<Second Press>

The second press 12 forms the lower step part 4 and the outer peripheral surface 4A (hereinafter also referred to as a second shape) of the product 1. The second press 12 comprises at least a punch 12A and a die 12B as dies for press-forming the second shape.

The punch 12A is a male die. The die 12B is a female die. The punch 12A shaped like a rectangular cylinder is movable relative to the die 12B so as to press the metal material P into a rectangular concave portion provided in the die 12B. In this way, the second shape of the product 1 is press-formed in the metal material P, and the product 1 is punched out of the metal material P.

A portion of the metal material P restrained by an inner peripheral surface of the concave portion is formed as the outer peripheral surface 4A. A stripper 12C spaces away the metal material P closely adhered around the punch 12A during relative movement of the punch 12A relative to the die 12B.

<Positioner>

As shown in FIG. 4, at least one of the first press 11 or the second press 12 comprises a first positioner 14 and a second positioner 15. The first positioner 14 and the second positioner 15 of the present embodiment are provided to a press that performs the last press-forming, namely, to the second press 12.

The first positioner 14 and the second positioner 15 have a function of positioning the dies of the second press 12, namely, the punch 12A and the die 12B.

Specifically, in the present embodiment, the dies arranged on the lower side relative to the metal material P (the punch 11A, the die 12B, and the die 13B) are fixed dies immovable relative to the metal material P during pressing. The dies arranged on the upper side relative to the metal material P (the die 11B, the punch 12A, and the punch 13A) are movable dies movable in a thickness direction of the metal material P during pressing.

As shown in FIG. 3, the movable dies 11B, 12A, and 13A are pressed toward the fixed dies 11A, 12B, and 13B, respectively, via a movable plate 16A. The fixed dies 11A, 12B, and 13B are positioned and fixed onto a fixed plate 16B.

Each of the first positioner 14 and the second positioner 15 positions the punch 12A and the die 12B on the movable plate 16A and the fixed plate 16B, respectively. The first positioner 14 and the second positioner 15 of the present embodiment each comprise a knock pin and a hole into which the knock pin is fitted.

Thus, the first positioner 14 and the second positioner 15 do not have a function of fixing the punch 12A and the die 12B to the movable plate 16A and the fixed plate 16B, respectively. The punch 12A and the die 12B are fixed to the movable plate 16A and the fixed plate 16B, respectively, by a fastening means such as a bolt or bolts (not shown), in a state positioned by the first positioner 14 or the second positioner 15.

The first positioner 14 positions the punch 12A and the die 12B in a first position on the movable plate 16A and the fixed plate 16B, respectively. The second positioner 15 positions the punch 12A and the die 12B in a second position on the movable plate 16A and the fixed plate 16B, respectively. The second position is deviated in a feeding direction with respect to the first position.

The second position increases a process interval as compared with that in the first position. The process interval refers to, for example, a distance between the center of the punch 12A and the die 12B and the center of the punch 11A and the die 11B. As shown in FIG. 4, the first positioner 14 comprises two first positioners 14A and 14B arranged diagonally to each other with respect to the center of the punch 12A and the die 12B.

The second positioner 15 comprises two second positioners 15A and 15B arranged in positions that are diagonal to each other with respect to the center of the punch 12A and the die 12B, and that are different from those where the first positioners 14A and 14B are arranged.

<Setting Method or Maintenance Method of Press Working Apparatus>

A setting method or a maintenance method of the press working apparatus 10 is, in effect, a method for setting the process interval. Specifically, when performing setting or maintenance of the press working apparatus 10, firstly, the first press 11 is operated and an elongation quantity of the metal material P is measured.

Next, a target value of the process interval is determined based on the measured elongation quantity, and then, an actual process interval is adjusted to the determined target value of the process interval. At this time, the actual process interval is adjusted to the determined target value of the process interval using the first positioner 14 or the second positioner 15.

If the determined target value of the process interval cannot be achieved with the first positioner 14 or the second positioner 15, a third positioner is newly provided to adjust the actual process interval to the determined target value of the process interval.

3. Characteristics of Press Working Apparatus of the Present Embodiment, and of Setting Method or Maintenance Method Thereof The metal material P is generally elongated by being subjected to press working. Thus, in relation to required dimensional accuracy, it is feared that, if the elongation quantity of the metal material P is large, a phenomenon may occur in which a position of the metal material P with respect to the dies is displaced from a proper position (also referred to as a "displacement phenomenon" herein).

In the present embodiment, it is possible to provide a process interval determined with consideration of the elongation quantity of the metal material P caused in the working process prior to the working process performed by the second press 12. Thus, the position of the punch 12A and the die 12B can be a proper position with consideration of the elongation quantity of the metal material P, resulting in obtainment of the dimensional accuracy equivalent to that obtained in cutting work.

In general press working apparatuses, press working required to achieve high dimensional accuracy is performed in the last step in each press working apparatus, in most cases. Thus, it is desirable that the first positioner 14 and the second positioner 15 be provided to the press that performs the last press-forming, namely, to the second press 12, as in the present embodiment. This enables obtainment of the dimensional accuracy equivalent to that obtained in cutting work.

Second Embodiment

The second press 12 of the above-described embodiment performs (a) the last press-forming and (b) punching in which the product 1 is punched out of the metal material P, by the press working by the second press 12.

Figure 5:
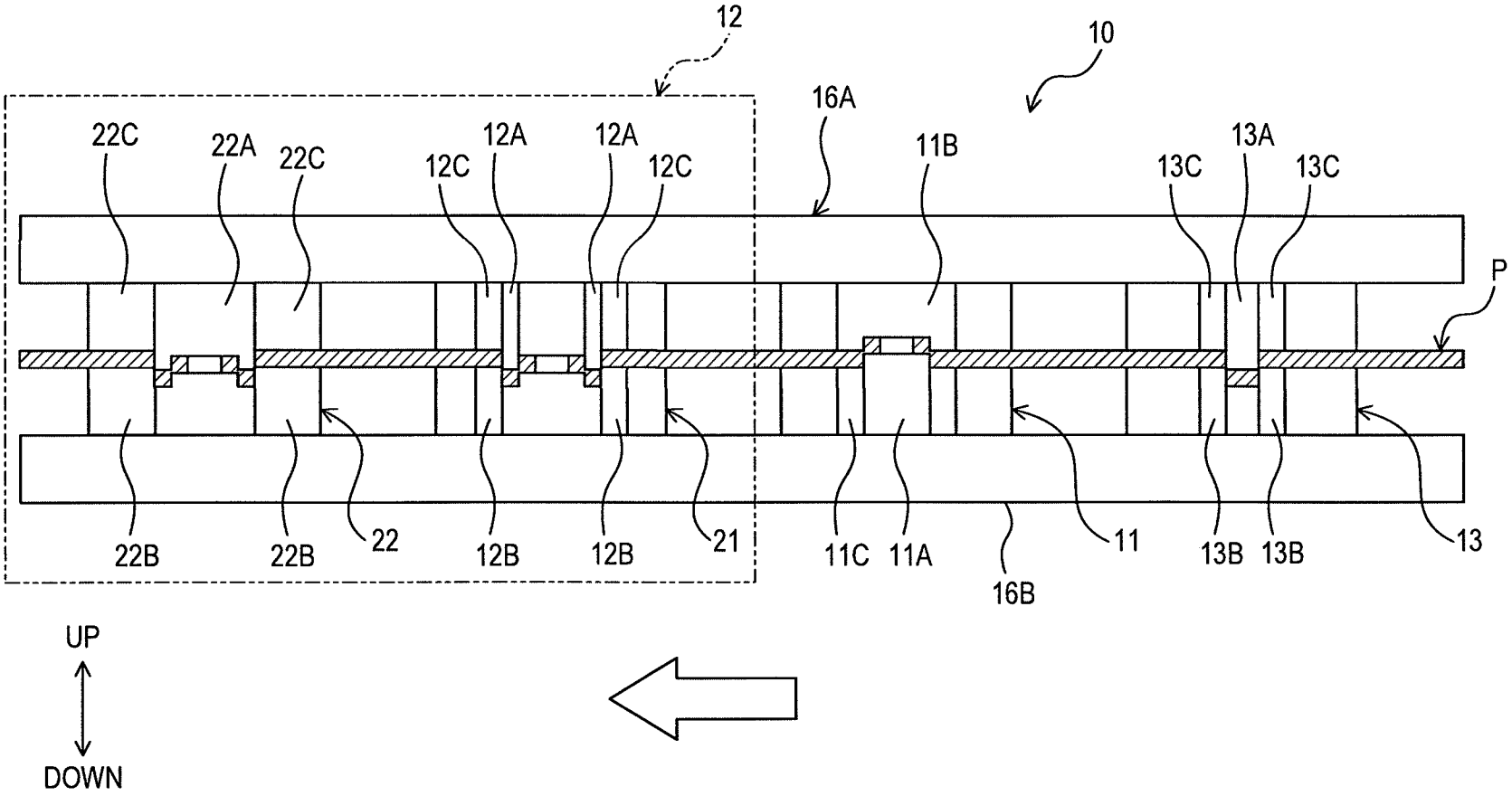
FIG. 5 is a diagram showing a press working apparatus according to a second embodiment.
Figure 6:
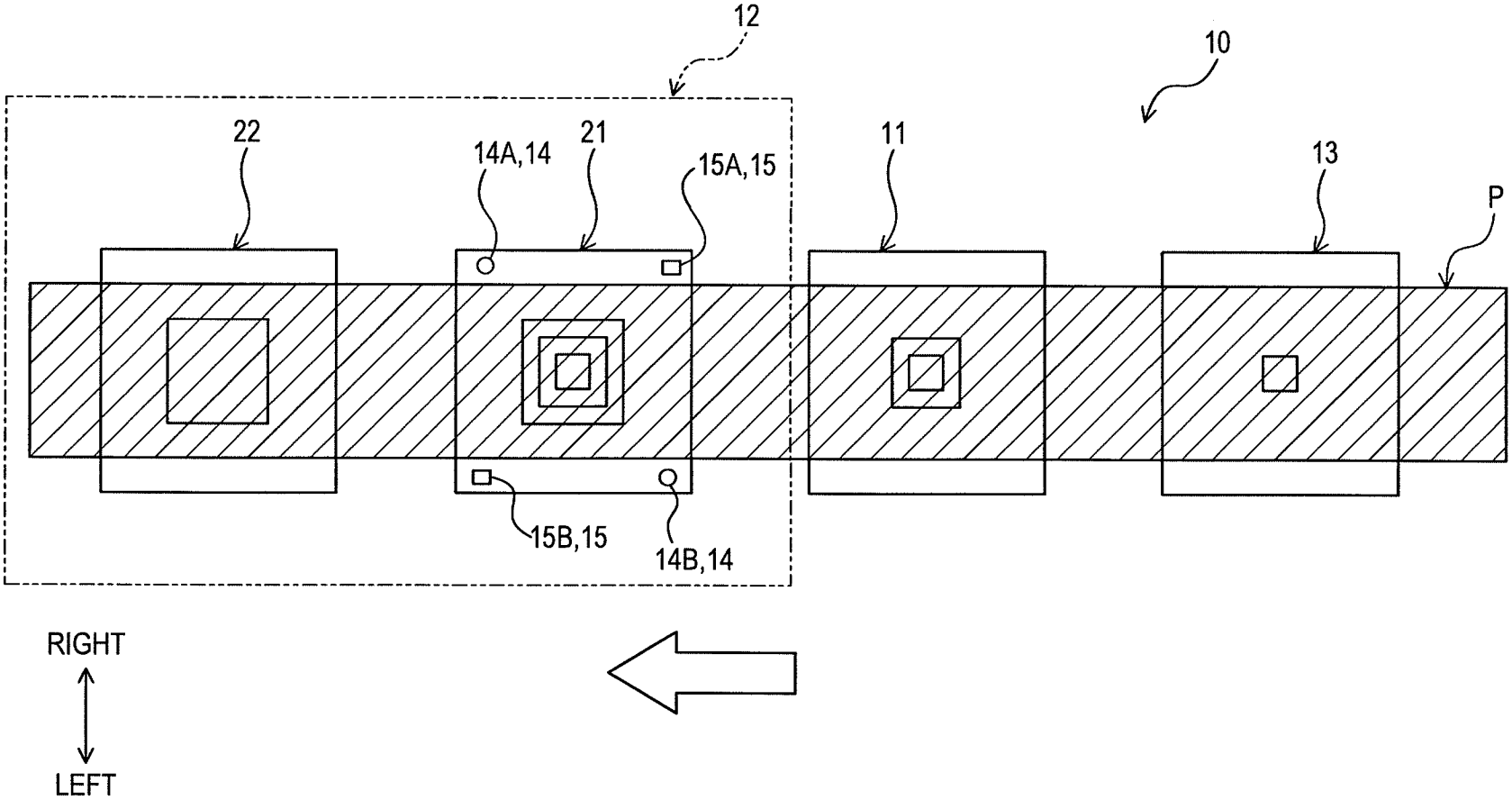
FIG. 6 is a diagram showing the press working apparatus according to the second embodiment.

On the other hand, in the present embodiment, as shown in FIGS. 5 and 6, two presses 21 and 22 perform processing similar to that performed by the second press 12 of the above-described embodiment, namely, (a) the last press-forming and (b) the punching.

The press 21 mainly performs the last press-forming. Thus, a configuration of the press 21 is the same as that of the second press 12 of the first embodiment. The press 22 performs the punching in which the product 1 subjected to the last press-forming in the press 21 is punched out of the metal material P.

The press 21 performs the last press-forming in a state where the product 1 is not completely punched out of the metal material P, or in other words, in a so-called "half-punched" state. A configuration of the press 22 is similar to that of the punch press 13.

Specifically, the press 22 comprises at least a punch 22A, a die 22B, and a stripper 22C. Components and so on that are the same as those in the above-described embodiment are assigned with the same reference numerals as in the above-described embodiment. Thus, in the present embodiment, repeated explanation is omitted.

Other Embodiments

In the above-described embodiments, the product 1 is formed through the three steps (in the punch press 13, the first press 11, and the second press 12 in this order). However, the present disclosure is not limited to this. Specifically, a configuration may be employed in which, for example, another forming press (pressing step) is present between the first press 11 and the second press 12, or in which the punch press 13 is not present.

Figure 2:
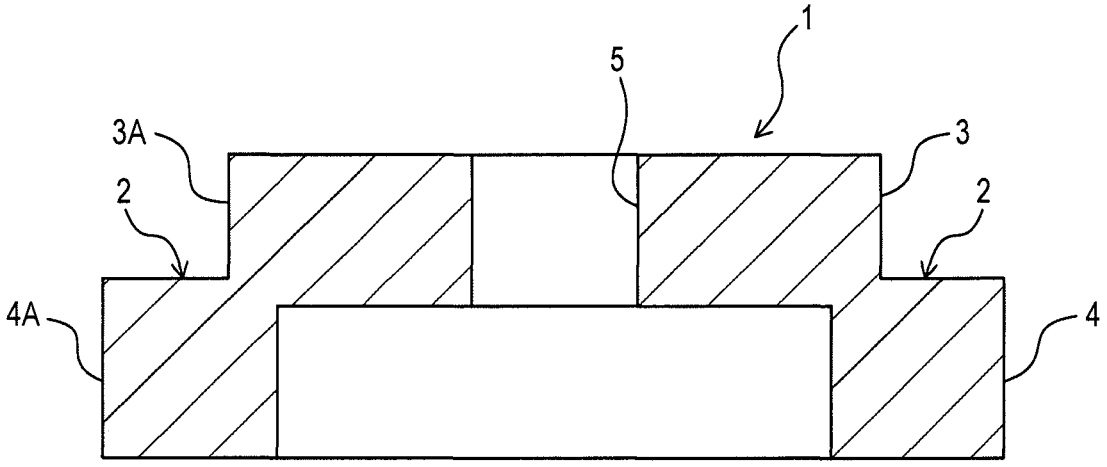
FIG. 2 is a diagram showing the product according to the first embodiment.

A product to be formed by the press working apparatus 10 of the above-described embodiments is not limited to the product 1 show in FIGS. 1 and 2. Specifically, the product to be formed may be, for example, a ratchet, a pole, a lower arm, and so on, for a recliner.

The arrangement of the punch 11A and the die 11B of the first press 11 of the above-described embodiments is upside down with respect to the arrangement of the punches 12A and 13A and the dies 12B and 13B of the respective other presses 12 and 13. This is because the product 1 includes the stepped portion 2. Thus, if the product 1 has a different shape, the configuration of the first press 11 may be different from that in the above-described embodiments. That is, the present disclosure is not limited to the above-described embodiments.

The press working apparatus 10 of the above-described embodiments comprises the presses 11 to 13 utilizing the principle of fine blanking processing. However, the present disclosure is not limited to this. Specifically, the present disclosure may comprise, for example, presses not utilizing the principle of fine blanking processing.

The first positioner 14 and the second positioner 15 of the above-described embodiments are provided to the press that performs the last press-forming, namely, to the second press 12. However, the present disclosure is not limited to this.

Specifically, the first positioner 14 and the second positioner 15 may be provided, for example, to a press other than the press that performs the last press-forming, namely, to the first press 11, or to all of the presses 11 to 13.

The first positioner 14 and the second positioner 15 of the above-described embodiments each comprise the knock pin and the hole into which the knock pin is fitted. However, the present disclosure is not limited to this. Specifically, the first positioner 14 and the second positioner 15 may comprise, for example, a fastening means such as a bolt or bolts.

In the above-described embodiments, if the determined target value of the process interval cannot be achieved with the first positioner 14 or the second positioner 15, the third positioner is newly provided. However, the present disclosure is not limited to this.

Specifically, steps may be performed, for example, of operating the first press 11 in a state where positioning is performed by the first positioner 14 and measuring the elongation quantity of the metal material P, of subsequently providing the second positioner 15 based on the measured elongation quantity, and of subsequently adjusting the actual process interval to the target value of the process interval determined based on the elongation quantity.

In the above-described second embodiment, the press 21 mainly performs the last press-forming, and the press 22 performs the punching. However, the present disclosure is not limited to this. Specifically, the present disclosure may be practiced with a configuration in which, for example, the press 21 and the press 22 collaborate to perform the last press-forming or in which three or more presses collaborate to perform the last press-forming.

Additionally, the present disclosure may be embodied in various forms conforming to the gist of the invention recited in the appended claims, and is not limited to the above-described embodiments. Thus, at least two of the above-described embodiments may be combined together.

What is claimed is:

1. A press working apparatus that plastically deforms a metal material having a strip-plate shape to form the metal material into a specified shape while feeding the metal material in a feeding direction, the apparatus comprising:

a first press comprising at least one die that press-forms a first shape in the metal material;

a second press comprising at least one die that press-forms a second shape in the metal material after the first shape is formed by the first press;

at least one first positioner provided to the second press, the at least one first positioner positioning the at least one die of the second press such that the at least one die of the second press is positioned at a first position; and at least one second positioner provided to the second press, the at least one second positioner positioning the at least one die of the second press such that the at least one die of the second press is positioned at a second position, the second position being deviated in the feeding direction with respect to the first position, wherein the at least one first positioner and the second positioner are configured such that the at least one die of the second press is positioned by using the at least one first positioner or the second positioner to change a distance in the feeding direction between a center of the at least one die of the first press and a center of the at least one die of the second press based on an elongation quantity of the metal material in the press-forming of the first shape by the first press prior to the press-forming of the second shape by the second press, the distance in the feeding direction between the center of the at least one die of the first press and the center of the at least one die of the second press is adjusted to a first distance when the at least one die of the second press is positioned at the first position by the at least one first positioner, the distance in the feeding direction between the center of the at least one die of the first press and the center of the at least one die of the second press is adjusted to a second distance when the at least one die of the second press is positioned at the second position by the at least one second positioner, and the first distance and the second distance differ from each other.

2. The press working apparatus according to claim 1, wherein the second press is a last press positioned along the feeding direction in the press working apparatus.

3. The press working apparatus according to claim 1, wherein the elongation quantity of the metal material is acquired after the first press is operated to form the first shape of the metal material;

a target value of a distance in the feeding direction between the center of the at least one die of the first press and the center of the at least one die of the second press is determined based on the elongation quantity; and an actual distance in the feeding direction between the center of the at least one die of the first press and the center of the at least one die of the second press is adjusted to the target value of the distance using the at least one first positioner.

4. The press working apparatus according to claim 1, wherein the elongation quantity of the metal material is acquired after the first press is operated to form the first shape of the metal material;

a target value of a distance in the feeding direction between the center of the at least one die of the first press and the center of the at least one die of the second press is determined based on the elongation quantity; and an actual distance in the feeding direction between the center of the at least one die of the first press and the center of the at least one die of the second press is adjusted to the target value of the distance using the at least one second positioner.

5. The press working apparatus according to claim 1, wherein the at least one first positioner comprises two first positioners, and one of the two first positioners is diagonally positioned from another of the two first positioners with respect to the at least one die of the second press.

6. The press working apparatus according to claim 1, wherein the second positioner comprises two second positioners, and one of the two second positioners is diagonally positioned from another of the two second positioners with respect to the at least one die of the second press.

7. The press working apparatus according to claim 1, wherein the at least one first positioner or the at least one second positioner positions the at least one die of the second press on a movable plate and a fixed plate, separately.

8. The press working apparatus according to claim 1, wherein the at least one first positioner and the at least one second positioner are both arranged on the second press and not the first press.

* * * * *